US010062323B2

(12) United States Patent
Cho

(10) Patent No.: US 10,062,323 B2
(45) Date of Patent: Aug. 28, 2018

(54) PIXEL, ORGANIC LIGHT EMITTING DISPLAY DEVICE INCLUDING THE PIXEL AND DRIVING METHOD OF ORGANIC LIGHT EMITTING DISPLAY DEVICE

(71) Applicant: SAMSUNG DISPLAY CO., LTD., Yongin-si, Gyeonggi-do (KR)

(72) Inventor: Geun Ho Cho, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 54 days.

(21) Appl. No.: 15/189,822

(22) Filed: Jun. 22, 2016

(65) Prior Publication Data

US 2016/0379560 A1 Dec. 29, 2016

(30) Foreign Application Priority Data

Jun. 26, 2015 (KR) ..... 10-2015-0091342

(51) Int. Cl.
*G09G 3/30* (2006.01)
*G09G 3/3225* (2016.01)
(Continued)

(52) U.S. Cl.
CPC ..... *G09G 3/3225* (2013.01); *G09G 3/3233* (2013.01); *G09G 3/3266* (2013.01);
(Continued)

(58) Field of Classification Search
CPC ... G09G 2300/0426; G09G 2300/0819; G09G 2300/0842; G09G 2300/0861;
(Continued)

(56) References Cited

U.S. PATENT DOCUMENTS

2004/0222943 A1 11/2004 Kudo et al.
2005/0219169 A1 10/2005 Chung et al.
(Continued)

FOREIGN PATENT DOCUMENTS

CN 104637431 A 5/2015
EP 2402932 A1 1/2012
(Continued)

OTHER PUBLICATIONS

EPO Extended Search Report dated Mar. 9, 2017, for corresponding European Patent Application No. 16176470.9 (26 pages).
(Continued)

*Primary Examiner* — Insa Sadio
(74) *Attorney, Agent, or Firm* — Lewis Roca Rothgerber Christie LLP

(57) ABSTRACT

A pixel includes an organic light emitting diode, and a driving circuit configured to supply current to the organic light emitting diode, the driving circuit including a driving transistor configured to control a level of the current flowing in the organic light emitting diode based on a level of a voltage supplied to a data line, and a first transistor including a first electrode electrically connected to an anode of the organic light emitting diode, a second electrode configured to receive an initialization power, and a gate electrode electrically connected to the data line, wherein the first transistor is configured to supply the initialization power to the anode of the organic light emitting diode when the first transistor is turned on such that the organic light emitting diode does not emit light.

15 Claims, 5 Drawing Sheets

(51) Int. Cl.
*G09G 3/3233* (2016.01)
*G09G 3/3266* (2016.01)

(52) U.S. Cl.
CPC ..... *G09G 2300/0426* (2013.01); *G09G 2300/0819* (2013.01); *G09G 2300/0842* (2013.01); *G09G 2300/0861* (2013.01); *G09G 2310/0232* (2013.01); *G09G 2310/0248* (2013.01); *G09G 2330/021* (2013.01); *G09G 2330/028* (2013.01)

(58) Field of Classification Search
CPC ... G09G 2310/0232; G09G 2310/0248; G09G 2330/021; G09G 2330/028; G09G 3/3225; G09G 3/3233; G09G 3/3266
See application file for complete search history.

(56) References Cited

U.S. PATENT DOCUMENTS

2007/0024552 A1* 2/2007 Shimizu ..... G09G 3/3614 345/87
2008/0055225 A1 3/2008 Pak et al.
2009/0284500 A1 11/2009 Yamashita
2009/0309856 A1* 12/2009 Yoo ..... G09G 3/3233 345/205
2010/0091001 A1 4/2010 Kim et al.
2012/0001896 A1* 1/2012 Han ..... G09G 3/3233 345/214
2013/0038596 A1 2/2013 Ono et al.
2013/0271501 A1 10/2013 Yang et al.
2015/0170576 A1 6/2015 Bae
2016/0358586 A1 12/2016 Song et al.

FOREIGN PATENT DOCUMENTS

KR 10-2012-0003423 A 1/2012
KR 10-2012-0041463 A 5/2012

OTHER PUBLICATIONS

EPO Partial Search Report dated Oct. 27, 2016, for corresponding European Patent Application No. 16176470.9 (7 pages).

* cited by examiner

PIXEL, ORGANIC LIGHT EMITTING DISPLAY DEVICE INCLUDING THE PIXEL AND DRIVING METHOD OF ORGANIC LIGHT EMITTING DISPLAY DEVICE

CROSS-REFERENCE TO RELATED APPLICATION

This application claims priority to, and the benefit of, Korean Patent Application No. 10-2015-0091342, filed on Jun. 26, 2015, in the Korean Intellectual Property Office, the entire contents of which are incorporated herein by reference in their entirety.

BACKGROUND

1. Field

Exemplary embodiments of the present invention relate to a pixel, an organic light emitting display device including the pixel, and a driving method of the organic light emitting display device.

2. Description of the Related Art

Recently, various display devices having reduced weight and dimensions, which are capable of eliminating disadvantages of a cathode ray tube (CRT), have been developed. Examples of these display devices include a liquid crystal display, a field emission display, plasma display panel, and an organic light emission display device.

In recent years, organic light emitting display devices have been employed as devices such as smart phones and pads as well as TVs. A study is in progress for providing a device, such as a smart phone or a pad, capable of recognizing movement of human body organs (hands, eyes, heads, and the like) to determine whether it is being used and, when it is not used by a human, capable of reducing power consumption.

SUMMARY

In view of the above, an exemplary embodiment of the present invention provides pixels, an organic light emitting display device including the pixels, and a signal driver, and a driving method of the organic light emitting display device. In this regard, when a portion of the organic light emitting display device is not used, a power amount is reduced by supplying data voltages having voltage levels that are lower than a given level to pixels included in the not-used portion thereof, such that organic light emitting diodes included in the pixels emit no light. In this case, the signal driver stops driving of the supply of scan signals to the non-emitting pixels to thereby reduce power consumption.

In accordance with an aspect of the present invention, there is provided a pixel including an organic light emitting diode, and a driving circuit configured to supply current to the organic light emitting diode, the driving circuit including a driving transistor configured to control a level of the current flowing in the organic light emitting diode based on a level of a voltage supplied to a data line, and a first transistor including a first electrode electrically connected to an anode of the organic light emitting diode, a second electrode configured to receive an initialization power, and a gate electrode electrically connected to the data line, wherein the first transistor is configured to supply the initialization power to the anode of the organic light emitting diode when the first transistor is turned on such that the organic light emitting diode does not emit light.

The driving circuit may further include a second transistor including a first electrode electrically connected to the data line, a second electrode electrically connected to a first electrode of the driving transistor, and a gate electrode electrically connected to a first scan line, a third transistor including a first electrode electrically connected to a second electrode of the driving transistor, a second electrode electrically connected to a gate electrode of the driving transistor, and a gate electrode electrically connected to the first scan line, a fourth transistor including a first electrode electrically connected to the gate electrode of the driving transistor, a second electrode configured to receive the initialization power, and a gate electrode electrically connected to a second scan line, a fifth transistor including a first electrode configured to receive a first power, a second electrode electrically connected to the first electrode of the driving transistor, and a gate electrode electrically connected to an emission control line, a sixth transistor including a first electrode electrically connected to the second electrode of the driving transistor, a second electrode electrically connected to the anode of the organic light emitting diode, and a gate electrode electrically connected to the emission control line, a seventh transistor including a first electrode electrically connected to the anode of the organic light emitting diode, a second electrode configured to receive the initialization power, and a gate electrode electrically connected to a third scan line, and a storage capacitor including a first end configured to receive the first power, and a second end electrically connected to the gate electrode of the driving transistor.

A cathode of the organic light emitting diode may be configured to receive a second power having a second voltage level that is lower than a first voltage level of the first power, and the first scan line may be configured to receive a scan signal after the scan signal is supplied to the second scan line and to the third scan line.

The driving transistor may include a first electrode that is configured to receive a first power, and a second electrode that is electrically connected to the anode of the organic light emitting diode, the driving circuit may further include a second transistor including a first electrode electrically connected to the data line, a second electrode electrically connected to a gate electrode of the driving transistor, and a gate electrode electrically connected to a scan line, and a storage capacitor including a first end configured to receive the first power, and a second end electrically connected to the gate electrode of the driving transistor, and a cathode of the organic light emitting diode may be configured to receive a second power having a second voltage level that is lower than a first voltage level of the first power.

In accordance with another aspect of the present invention, there is provided an organic light emitting display device including a display panel including a first display area and a second display area that do not overlap each other, and a display panel driver configured to drive the display panel, the display panel including scan lines configured to transfer scan signals, data lines configured to transfer data voltages, and pixels in the first display area or the second display area and electrically connected to the scan lines and the data lines, wherein the display panel driver includes a data driver configured to generate the data voltages based on received image signals, a first signal driver configured to generate scan signals that are supplied to the first display area, and a second signal driver configured to generate scan signals that are supplied to the second display area, and wherein, when a predetermined condition is satisfied, the first signal driver is not driven and the pixels in the first display area do not emit light.

The first display area may be flat, and the second display area may be curved.

The display panel may further include bridge transistors between the first display area and the second display area, and the scan signals supplied to the second display area might not be supplied to the first display area, and the scan signals supplied to the first display area might not be supplied to the second display area, when the bridge transistors are turned off.

Each of the pixels in the first display area may include an organic light emitting diode, and a driving circuit configured to supply a current to the organic light emitting diode, the driving circuit may include a driving transistor configured to control a level of current flowing in the organic light emitting diode based on a level of a voltage supplied to one of the data lines, and a first transistor including a first electrode electrically connected to an anode of the organic light emitting diode, a second electrode configured to receive an initialization power, and a gate electrode electrically connected to the one of the data lines, and the first transistor may be configured to be turned on to supply the initialization power to the organic light emitting diode when the predetermined condition is satisfied.

The organic light emitting display device may further include emission control lines configured to transfer emission control signals to the pixels, the first signal driver may be further configured to generate the emission control signals supplied to the first display area, the second signal driver may be further configured to generate the emission control signals supplied to the second display area, the driving circuit may further include a second transistor including a first electrode electrically connected to the data line, a second electrode electrically connected to a first electrode of the driving transistor, and a gate electrode electrically connected to a first scan line, a third transistor including a first electrode electrically connected to a second electrode of the driving transistor, a second electrode electrically connected to a gate electrode of the driving transistor, and a gate electrode electrically connected to the first scan line, a fourth transistor including a first electrode electrically connected to the gate electrode of the driving transistor, a second electrode configured to receive the initialization power, and a gate electrode electrically connected to a second scan line, a fifth transistor including a first electrode configured to receive a first power, a second electrode electrically connected to the first electrode of the driving transistor, and a gate electrode electrically connected to an emission control line, a sixth transistor including a first electrode electrically connected to the second electrode of the driving transistor, a second electrode electrically connected to the anode of the organic light emitting diode, and a gate electrode electrically connected to the emission control line, a seventh transistor including a first electrode electrically connected to the anode of the organic light emitting diode, a second electrode configured to receive the initialization power, and a gate electrode electrically connected to a third scan line, and a storage capacitor including a first end configured to receive the first power, and a second end electrically connected to the gate electrode of the driving transistor, and a cathode of the organic light emitting diode may be configured to receive a voltage level of a second power that is lower than a voltage level of the first power.

Each of the pixels may have a same structure.

The display panel driver may further include a timing controller that is configured to generate a data timing control signal and a scan timing control signal based on externally supplied image signals or timing signals, output the image signals and the data timing control signal to the data driver, drive the first signal driver and the second signal driver, and output the scan timing control signal to the first signal driver and the second signal driver, when a use-determining signal having a first logic value is received, and drive the second signal driver, and output the scan timing control signal to the second signal driver, when the use-determining signal having a second logic value that is different from the first logic value is received.

The timing controller may be further configured to generate an emission timing control signal, output the emission timing control signal to the first signal driver and to the second signal driver when the use-determining signal having the first logic value is received, and output a scan timing control signal and the emission timing control signal to the second signal driver when the use-determining signal having the second logic value is received.

In accordance with yet another aspect of the present invention, there is provided a driving method of an organic light emitting display device including a display panel having a first display area and a second display area that do not overlap each other, and a display panel driver configured to drive the display panel, the method including determining whether the first display area is used, driving the first display area and the second display area when it is determined that the first display area is used, and driving the second display area when it is determined that the first display area is not used.

The determining whether the first display area is used may include receiving and analyzing a use-determining signal when the use-determining signal is received from the outside, and determining that the first display area is used when the use-determining signal has a first logic value, and determining that the first display area is not used when the use-determining signal has a second logic value that is different from the first logic value, or receiving and analyzing image signals when the use-determining signal is not received from the outside, and determining that the first display area is used when at least one of the image signals corresponding to the first display area does not correspond to black grays, and determining that the first display area is not used when all of the image signals corresponding to the first display area corresponds to black grays.

The display panel may further include bridge transistors between the first display area and the second display area, scan lines configured to transfer scan signals, data lines configured to transfer data voltages, and pixels in the first display area or the second display area and electrically connected to the scan lines and the data lines, the display panel driver may include a data driver configured to generate the data voltages based on received image signals, a first signal driver configured to generate scan signals supplied to the first display area, and a second signal driver configured to generate scan signals supplied to the second display area, and the driving of the second display area may include supplying data voltages having voltage levels that are lower than a given voltage level to data lines corresponding to the first display area, stopping the driving of the first signal driver, and turning off the bridge transistors.

Each of the pixels may include an organic light emitting diode, and a driving circuit configured to supply current to the organic light emitting diode, the driving circuit including a driving transistor configured to control a level of current flowing in the organic light emitting diode based on a voltage level supplied to one of the data lines, and a first transistor including a first electrode electrically connected to an anode of the organic light emitting diode, a second electrode configured to receive an initialization power, and a gate electrode electrically connected to the one of the data lines, and the supplying data voltages having voltage levels that are lower than a given voltage level to data lines corresponding to the first display area may include turning on the first transistor, and supplying the initialization power to the anode of the organic light emitting diode to prevent light emission from the organic light emitting diode.

The driving of the first display area and the second display area may include generating data voltages corresponding to the received image signals to the data lines, supplying a first scan timing control signal and a second scan timing control signal to the first signal driver and the second signal driver, respectively, and turning on the bridge transistors.

In accordance with aspects of embodiments of the present invention, it is possible to provide pixels, an organic light emitting display device including the pixels, and a signal driver, and to provide a driving method of the organic light emitting display device. In this regard, when a portion of the organic light emitting display device is not used, a power amount is reduced by supplying data voltages of which levels are lower than a predetermined level to pixels included in the not-used portion thereof such that organic light emitting diodes included in the pixels emit no light. In this case, the signal driver stops driving the supply of scan signals to the non-emitting pixels to reduce power consumption.

BRIEF DESCRIPTION OF THE DRAWINGS

Example embodiments will now be described more fully hereinafter with reference to the accompanying drawings, wherein.

DETAILED DESCRIPTION

Figure 1:
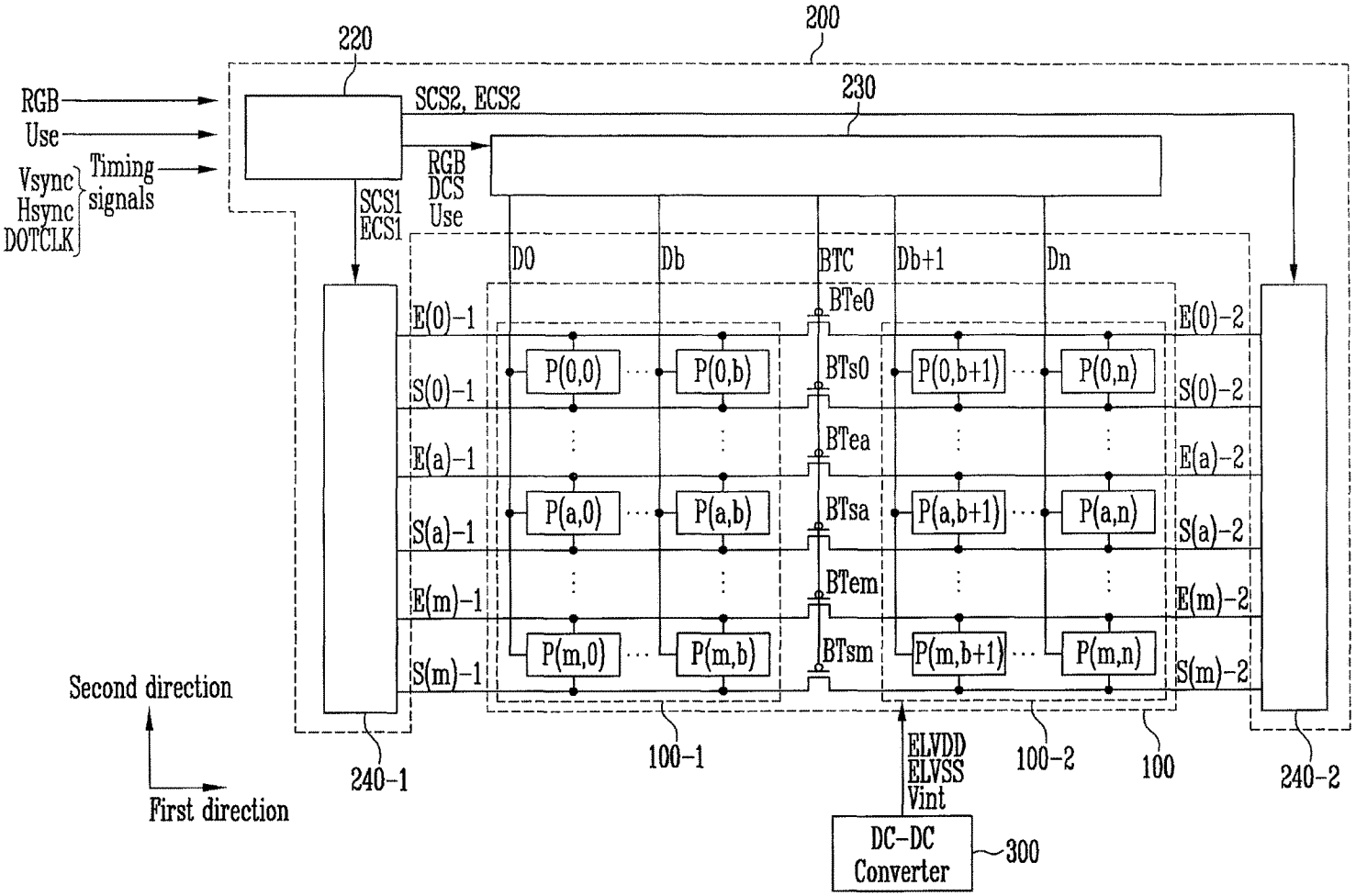
FIG. 1 is a view for describing an organic light emitting display device according to an exemplary embodiment of the present invention.

Features of the inventive concept and methods of accomplishing the same may be understood more readily by reference to the following detailed description of embodiments and the accompanying drawings. The inventive concept may, however, be embodied in many different forms and should not be construed as being limited to the embodiments set forth herein. Hereinafter, example embodiments will be described in more detail with reference to the accompanying drawings, in which like reference numbers refer to like elements throughout. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof will not be repeated. In the drawings, the relative sizes of elements, layers, and regions may be exaggerated for clarity.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present invention. As used herein, the singular forms "a," "an," and "the" are intended to include the plural forms as well, unless the context clearly indicates otherwise. It will be further understood that the terms "comprises," "comprising," "includes," and "including,"

when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

FIG. 1 is a view for describing an organic light emitting display device according to an exemplary embodiment of the present invention. The organic light emitting display device includes a display panel 100, a display panel driver 200 for driving the display panel 100, and a power supply (e.g., a DC-DC converter) 300 for supplying a power to the display panel 100.

The display panel 100 includes a first display area 100-1 and a second display area 100-2, which do not overlap each other. The first display area 100-1 may be flat, and the second display area 100-2 may be curved. When a smart phone is used as an example, the first display area 100-1 might be driven only when the smart phone is used by a user, such as by use of a button or the like mounted on a touch screen panel or on other hardware, and the second display area 100-2 may be driven when the smart phone is not used by a user. When a call request or a message is received, the first display area 100-1 might not be driven, while the second display area 100-2 may be driven.

The display panel 100 includes first scan lines S(0)-1 . . . , S(a)-1 . . . , and S(m)-1 (the first scan lines hereinafter being referred to as first scan lines S-1) for transferring scan signals to the first display area 100-1 (m being a positive integer, and a being in a range from 0 to m), second scan lines S(0)-2 . . . S(a)-2 . . . , and S(m)-2 (the second scan lines hereinafter being referred to as S-2) for transferring scan signals to the second display area 100-2, first emission control lines E(0)-1 . . . E(a)-1 . . . , and E(m)-1 (hereinafter, referred to as first emission control lines E-1) for transferring emission control signals to the first display area 100-1, second emission control lines E(0)-2, E(a)-2 . . . , and. E(m)-2 (hereinafter, referred to as second emission control lines E-2) for transferring emission control signals to the second display area 100-2, data lines D0 . . . Db, Db+1 . . . , and Dn (referred to as data lines D) for transferring data voltages to the display panel 100 (n being a positive integer, and b being in a range from 0 to n), and pixels P(0,0) to P(m,n) (hereinafter, referred to as pixels P) that are electrically connected to the first scan lines S-1, the second scan lines S-2, the first emission control lines E-1, the second emission control lines E-2, and the data lines D. Each of the pixels P may have the same structure. The first scan lines S-1 and the second scan lines S-2 may be collectively referred to as scan lines S, and the first emission control lines E-1 and the second emission control lines E-2 may be collectively referred to as emission control lines E.

According to another exemplary embodiment of the present invention, the emission control lines E may be omitted. In the present embodiment, pixels P(0, 0) to P(m, b) are included in the first display area 100-1, and pixels P (0, b+1) to P(m, n) are included in the second display area 100-2. The pixels P(0, 0) to P(m, b) may be defined as first pixels P-1, and pixels P (0, b+1) to P(m, n) may be defined as the second pixels P-2. Further, the data lines D0 to Db may be defined as first data lines D-1, and data lines Db+1 to Dn may be defined as second data lines D-2. An example pixel P(a, b) included in the first display area 100-1 is electrically connected to the scan line S(a)-1, the data line Db, and the emission control line E(a)-1, but this is merely an example. Alternatively, the example pixel P(a, b) may be electrically connected to two or more scan lines, and may be electrically connected to two or more emission control lines.

Bridge transistors BTe0, BTs0 . . . , BTem, and BTsm (hereinafter, referred to as bridge transistors BT) may be included between the first display area 100-1 and the second display area 100-2 according to another exemplary embodiment. The bridge transistors BT include scan bridge transistors BTs0 . . . , BTsa . . . , and BTsm (hereinafter, referred to as scan bridge transistors BTs), which are connected between respective ones of the scan lines S and respective emission control bridge transistors BTe0 . . . BTea . . . , and BTem (hereinafter, referred to as control bridge transistors BTe), which are connected between respective ones of the emission control lines E. The display panel 100 may further include a bridge transistor control line BTC, and a gate electrode of each of the bridge transistors BT may be electrically connected to the bridge transistor control line BTC. When the first display area 100-1 and the second display area 100-2 are both driven, the bridge transistors BT may be turned on to smoothly supply the scan signals and the emission control signals to the pixels P. When the second display area 100-2 is exclusively driven to the exclusion of the first display area 100-1, the emission signals and the scan signals for the second pixels P-2 may otherwise cause the first pixels P-1 to malfunction. Accordingly, the bridge transistors BT may be turned off.

The display panel driver 200 includes a timing controller 220, a data driver 230, a first signal driver 240-1, and a second signal driver 240-2.

The timing controller 220 receives externally supplied image signals RGB and timing signals "Timing signals." The timing signals "Timing signals" include a vertical synchronization signal Vsync, a horizontal synchronization signal Hsync, and a dot clock DOTCLK. The timing controller 220 outputs image signals RGB and a data timing control signal DCS to the data driver 230 based on the image signals RGB and the timing signals "Timing signals," outputs a first scan timing control signal SCSI and a first emission timing control signal ECS1 to the first signal driver 240-1, and outputs a second scan timing control signal SCS2 and a second emission timing control signal ECS2 to the second signal driver 240-2. According to another exemplary embodiment, the timing controller 220 may further receive an externally supplied use-determining signal "Use."

When a flip cover of smart device including an organic light emitting display device is opened, it is determined that a user intends to use the organic light emitting display device. As a result, a use-determining signal "Use" having a first logic value may be formed by an external device. In contrast, when the flip cover is closed, it is determined that a user is not using the organic light emitting display device. As a result, a use-determining signal "Use" having a second logic value that is different from the first logic value may be formed by the external device. In this regard, the first logic value of the use-determining signal "Use" may have a high level, and the second logic value may have a low level, although this is merely an example.

When the use-determining signal "Use" having the first logic value is received, both of the first signal driver 240-1 and the second signal driver 240-2 may be driven. The first scan timing control signal SCSI may correspond to the second scan timing control signal SCS2, and the first emission timing control signal ECS1 may correspond to the second emission timing control signal ECS2. When the use-determining signal "Use" having the second logic value is received, the second signal driver 240-2 may be exclusively driven to the exclusion of the first signal driver 240-1, and the first scan timing control signal SCSI and the first emission timing control signal ECS1 might not be outputted.

In FIG. 1, the use-determining signal "Use" is externally supplied to the timing controller 220, but this is merely an example. Alternatively, the timing controller 220 may generate the use-determining signal "Use" by directly determining whether to be used without receiving the use-determining signal "Use". For example, when the first display area 100-1 is not driven, all image signals corresponding to the first display area 100-1 among the image signals RGB may correspond to a black gray. The timing controller 220 may determine that the first display area 100-1 is not used when all of the image signals corresponding to the first display area 100-1 among the image signals RGB correspond to the black gray. In this case, the timing controller 220 may generate the use-determining signal "Use" having the second logic value, may exclusively drive the second signal driver 240-2 to the exclusion of the first signal driver 240-1, and might not output the first scan timing control signal SCS1 and the first emission timing control signal ECS1. In contrast, when at least some of the image signals corresponding to the first display area 100-1 among the image signals RGB do not correspond to the black gray, the timing controller 220 may generate the use-determining signal "Use" having the first logic value, may drive both the first signal driver 240-1 and the second signal driver 240-2, and may also output the first scan timing control signal SCSI and the first emission timing control signal ECS1. According to another exemplary embodiment, when the emission control lines E are omitted, the first emission timing control signal ECS1 and the second emission timing control signal ECS2 may also be omitted. The timing controller 220 may transmit the use-determining signal "Use" to the data driver 230.

The data driver 230 latches image data RGB inputted from the timing controller 220 in response to the data timing control signal DCS. When the use-determining signal "Use" having the first logic value is received, the data driver 230 supplies a voltage for turning on the bridge transistors BT to the bridge transistor control line BTC. In contrast, when the use-determining signal "Use" having the second logic value is received, the data driver 230 supplies a voltage for turning off the bridge transistors BT to the bridge transistor control line BTC. A level of the voltage supplied to the bridge transistor control line BTC when the use-determining signal "Use" having the first logic value may be lower than a level of the voltage supplied to the bridge transistor control line BTC when the use-determining signal "Use" having the second logic value is received. The data driver 230 may include a plurality of source drives IC, and the source drives IC may be electrically connected to the bridge transistor control line BTC and to the data lines D of the display panel 100 through a chip on glass (COG) process or through a tape automated bonding (TAB) process.

The first signal driver 240-1 sequentially supplies scan signals to the first scan lines S-1 in response to the first scan timing control signal SCS1. The first signal driver 240-1 may be directly formed on the substrate of the display panel 100 by a gate in panel (GIP) method, or may be electrically connected to the first scan lines S-1 of the display panel 100 by a TAB process. When the first emission control lines E-1 are formed on the display panel 100, the first signal driver 240-1 sequentially supplies emission control signals to the first emission control lines E-1 in response to the first emission timing control signal ECS1.

The second signal driver 240-2 sequentially supplies scan signals to the second scan lines S-2 in response to the second scan timing control signal SCS2. The second signal driver 240-2 may be directly formed on the substrate of the display panel 100 by the GIP method, or may be electrically connected to the second scan lines S-2 of the display panel 100 by the TAB process. When the second emission control lines E-2 are formed on the display panel 100, the second signal driver 240-2 sequentially supplies emission control signals to the second emission control lines E-2 in response to the second emission timing control signal ECS2.

The power supply 300 supplies a first power ELVDD, a second power ELVSS, and an initialization power Vint to the display panel 100. A voltage level of the initialization power Vint is set to turn off the organic light emitting diode OLED(a, b) when the initialization power Vint is supplied to the anode "Anode" (see FIG. 2). For example, the voltage level of the initialization power Vint may be lower than a voltage level of the first power ELVDD, and may be higher or lower than that of the second power ELVSS.

Figure 2:
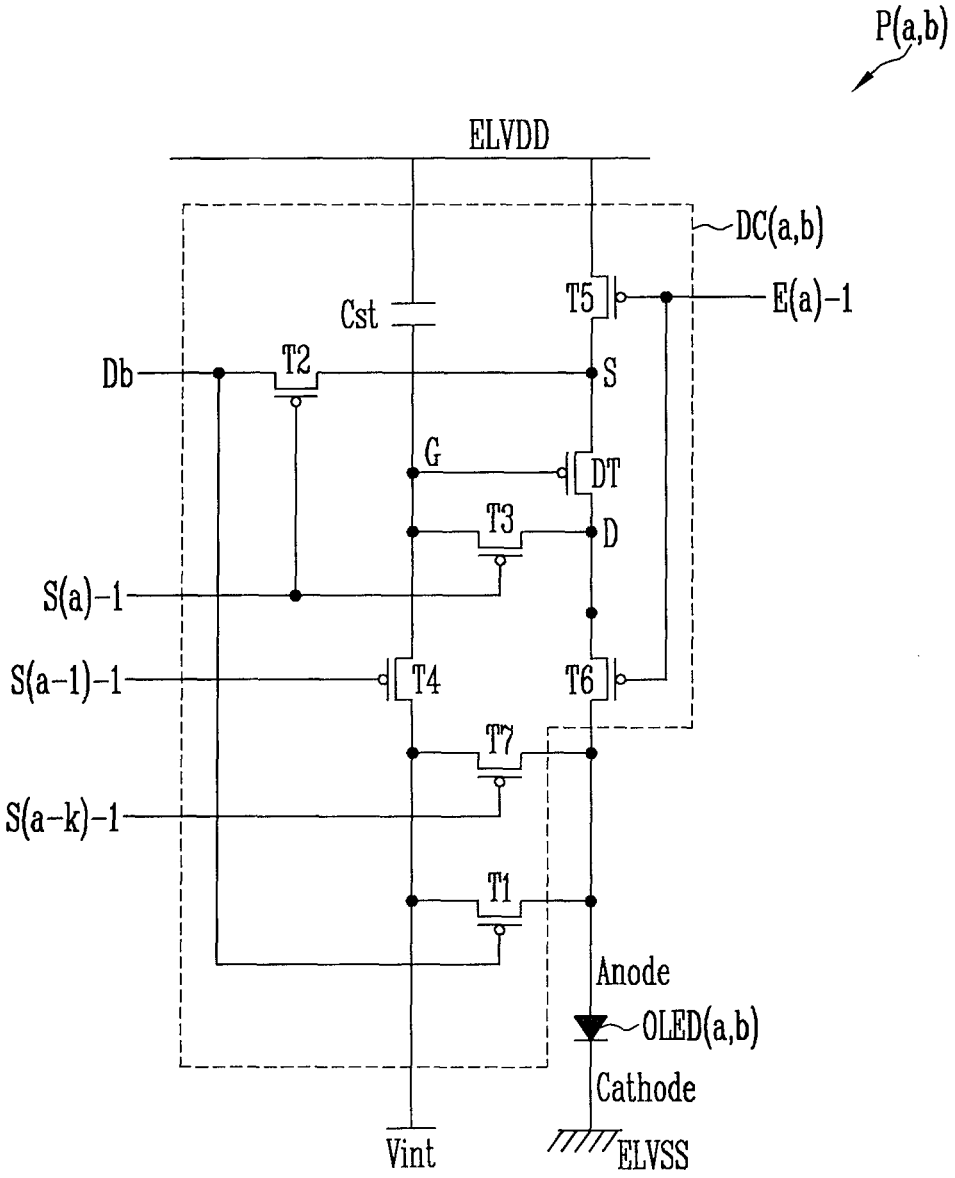
FIG. 2 is a view for describing an example of a structure of pixels included in the display panel of FIG. 1.

FIG. 2 is a view for describing an example of a structure of pixels included in the display panel of FIG. 1. For convenience of description, the pixel P(a, b) among the pixels P will be described.

The pixel P(a, b) includes an organic light emitting diode OLED(a, b) and a driving circuit DC(a, b) for supplying current to the organic light emitting diode OLED(a, b), and the driving circuit DC(a, b) includes a driving transistor DT, first to seventh transistors T1 to T7, and a storage capacitor Cst. The organic light emitting diode OLED(a, b) includes an anode "Anode" and a cathode "Cathode." The pixel P(a, b) is electrically connected to a data line Db, scan lines S(a)-1, S(a-1)-1, and S(a-k)-1 (k being a natural number), and an emission control line E(a)-1. The driving transistor DT and the first to seventh transistors T1 to T7 may each be a pMOS transistor, or may be an nMOS transistor.

The driving transistor DT controls the level of a current flowing in the organic light emitting diode OLED(a, b) based on the level of a voltage supplied to the data line Db that is electrically connected to the pixel P(a, b). A first electrode of the driving transistor DT may serve as any one of the source electrode and the drain electrode, and the second electrode may serve as the other one of the source electrode and the drain electrode. In this regard, for the convenience of description, the first electrode of the driving transistor DT may serve as the source electrode, and the second electrode of the driving transistor DT may serve as the drain electrode. However, this is merely an example. According to types of the transistors, it may be determined whether the first electrode serves as the source electrode or the drain electrode, and whether the second electrode serves as the source electrode or the drain electrode. A method by which the driving transistor DT controls the level of a current flowing in the organic light emitting diode OLED(a, b) will be described in detail later.

A first electrode of the first transistor T1 is electrically connected to the anode "Anode" of the organic light emitting diode OLED(a, b), the Initialization power Vint is supplied to a second electrode of the first transistor T1, and a gate electrode of the first transistor T1 is electrically connected to the data line Db. When the level of a data voltage supplied to the data line Db is equal to or lower than a given voltage level (e.g., 0 V), the first transistor T1 is turned on to supply the initialization power Vint to the anode "Anode" of the organic light emitting diode OLED(a, b), and as a result, the organic light emitting diode OLED(a, b) does not emit light.

A first electrode of the second transistor T2 is electrically connected to the data line Db, a second electrode of the second transistor T2 is electrically connected to the first electrode of the driving transistor DT, and a gate electrode of the second transistor T2 is electrically connected to the scan line S(a)-1. When a scan signal is supplied to the scan line S(a)-1, the second transistor T2 is turned on to supply a data voltage from the data line Db to the first electrode of the driving transistor DT.

A first electrode of the third transistor T3 is electrically connected to the second electrode of the driving transistor DT, a second electrode of the third transistor T3 is electrically connected to the gate electrode of the driving transistor DT, and a gate electrode of the third transistor T3 is electrically connected to the scan line S(a)-1. When a scan signal is supplied to the scan line S(a)-1, the third transistor T3 is turned on, and the gate electrode of the driving transistor DT is electrically connected to the second electrode of the driving transistor DT. That is, the driving transistor DT is diode connected.

A first electrode of the fourth transistor T4 is electrically connected to the gate electrode of driving transistor DT, the initialization power Vint is supplied to a second electrode of the fourth transistor T4, and a gate electrode of the fourth transistor T4 is electrically connected to the scan line S(a-1)-1. When a scan signal is supplied to a scan line S(a-1)-1, the fourth transistor T4 is turned on, and the initialization power Vint is supplied to the gate electrode of the driving transistor DT. When the scan signal is sequentially supplied to the first scan lines S-1, the scan signal is supplied to the scan line S(a)-1 after the scan signal is supplied to the scan line S(a-1)-1.

The first power ELVDD is supplied to a first electrode of the fifth transistor T5, a second electrode of the fifth transistor T5 is electrically connected to the first electrode of the driving transistor DT, and a gate electrode of the fifth transistor T5 is electrically connected to the emission control line E(a)-1. While an emission control signal is supplied to the emission control line E(a)-1, the fifth transistor T5 is turned on, and the first power ELVDD is supplied to the first electrode of the driving transistor DT. When no emission control signal is supplied to the emission control line E(a)-1, the first power ELVDD is not supplied to the first electrode of the driving transistor DT, and thus the organic light emitting diode OLED(a, b) does not emit light.

A first electrode of the sixth transistor T6 is electrically connected to the second electrode of the driving transistor DT, a second electrode of the sixth transistor T6 is electrically connected to the anode "Anode" of the organic light emitting diode OLED(a, b), and a gate electrode of the sixth transistor T6 is electrically connected to the emission control line E(a)-1. While the emission control signal is supplied to the emission control line E(a)-1, the sixth transistor T6 is turned on, and the second electrode of the driving transistor DT is electrically connected to the anode. When no emission control signal is supplied to the emission control line E(a)-1, a current flowing in the second electrode of the driving transistor DT does not reach the anode "Anode," and thus the organic light emitting diode OLED(a, b) does not emit light. As a result, only when the emission control signal is supplied to the emission control line E(a)-1, thereby turning on both of the fifth transistor T5 and the sixth transistor T6, the organic light emitting diode OLED(a, b) can emit light.

A first electrode of the seventh transistor T7 is electrically connected to the anode "Anode" of the organic light emitting diode OLED(a, b), the initialization power Vint is supplied to a second electrode of the seventh transistor T7, and a gate electrode of the seventh transistor T7 is electrically connected to the scan line S(a-k)-1 (k being an integer that is greater than 1). When the scan signal is supplied to the scan line S(a-k)-1 , the seventh transistor T7 is turned on to supply the initialization power Vint to the anode "Anode." As a result, the organic light emitting diode OLED(a, b) does not emit light. The scan signal is supplied to the scan line S(a)-1 after the scan signal is supplied to the scan line S(a-k)-1. Further, when k is 1, a time at which the scan signal is supplied to the scan line S(a-1)-1 corresponds to a time at which the scan signal is supplied to the scan line S(a-k)-1.

The first power ELVDD is supplied to a first end of the storage capacitor Cst, and a second end of the storage capacitor Cst is electrically connected to the gate electrode of the driving transistor DT. The storage capacitor Cst maintains a voltage difference between the first power ELVDD and the gate electrode of the driving transistor DT.

A driving method of the pixel P(a, b) will be described in detail. Since it is assumed that the pixel P(a, b) is driven, it may be assumed that the level of a voltage supplied through the data line Db is equal to or greater than a given voltage level (e.g., 2 V). As a result, the first transistor T1 maintains a turn-off state. In this regard, for the convenience of description, k is assumed to be 1.

While a scan signal is supplied to the scan line S(a-1)-1, no emission control signal is supplied to the emission control line E(a)-1. Accordingly, the first, second, third, fifth and sixth transistors T1, T2, T3, T5, and T6 are turned off, and the fourth and seventh transistors T4 and T7 are turned on. The initialization power Vint is supplied to the anode "Anode" and to the gate electrode of the driving transistor DT. Accordingly, the organic light emitting diode OLED(a, b) does not emit light.

Even when the supply of the scan signal to the scan line S(a-1)-1 is stopped, and while the scan signal is supplied to the scan line S(a)-1, the emission control signal is not supplied to the emission control line E(a)-1. Accordingly, the first, fourth, fifth, sixth and seventh transistors T1, T4, T5, T6, and T7 are turned off, and the second and third transistors T2 and T3 are turned on. A data voltage from the data line Db is supplied to the first electrode of the driving transistor DT, and the level of a voltage of the gate electrode of the driving transistor DT is increased until a voltage difference between the gate electrode of the driving transistor DT and the data voltage from the data line Db reaches a threshold voltage of the driving transistor DT.

The emission control signal is supplied to the emission control line E(a)-1 after the supply of the scan signal to the scan line S(a)-1 is stopped. The first, second, third, fourth, seventh transistors T1, T2, T3, T4 and T7 are turned off, and the fifth and sixth transistors T5 and T6 are turned on. The first power ELVDD is supplied to the first electrode of the driving transistor DT, and the second electrode of the driving transistor DT is electrically connected to the anode "Anode." The level of a current flowing in the organic light emitting diode OLED(a, b) may be controlled by the driving transistor DT, and may be calculated by using Equation 1.

$$Ids=k(Vgs-Vth)^2 \quad \text{Equation 1}$$

Ids: the level of the current flowing between the first electrode and the second electrode of the driving transistor DT, k: a proportional factor, Vgs: a difference between the gate electrode of the driving transistor DT and the voltage level of the first electrode, and Vth: the threshold voltage of the driving transistor DT.

However, while the scan signal is supplied to the scan line S(a)-1, the voltage difference between the gate electrode of the driving transistor DT and the data voltage from the data line Db reaches the threshold voltage of the driving transistor DT. Accordingly, Equation 1 is represented by Equation 2.

$$Ids=k\{(ELVDD-(Vdata-Vth))-Vth\}^2=k\{ELVDD-Vdata\}^2 \quad \text{Equation 2}$$

Ids: the level of the current flowing between the first electrode and the second electrode of the driving transistor DT, k: the proportional factor, ELVDD: a voltage level of the first power ELVDD, Vdata: a level of the data voltage supplied to the data line Db, and Vth: a threshold voltage of the driving transistor DT.

Because luminance of light emitted from the organic light emitting diode OLED(a, b) is proportional to the level of a supplied current, the organic light emitting diode OLED(a, b) may emit light regardless of the threshold voltage Vth of the driving transistor DT.

In the case where the first display area 100-1 is requested to display black, when the level of the data voltage supplied through the data line Db is lower than a given voltage level (e.g., 0 V), the first transistor T1 is turned on to keep the organic light emitting diode OLED(a, b) from emitting light. As a result, although the first signal driver 240-1 and the second transistor T2 to the seventh transistor T7 included in the pixel P(a,b) are not driven, the first display area 100-1 can display black.

In the case where the first transistor T1 is omitted, when the first display area 100-1 is to display black, a black signal is transmitted from the data line Db, and a signal is delivered to the scan lines S(a)-1, S(a-1)-1, S(a-k)-1 and the emission control line E(a)-1. Accordingly, in the case of the data driver 230, the first signal driver 240-1, and the second signal driver 240-2, more power is consumed, because the second signal driver 240-2 is required to be driven when it is difficult for the first signal driver 240-1 to smoothly transmit signals to the first display area 100-1 alone.

Figure 3:
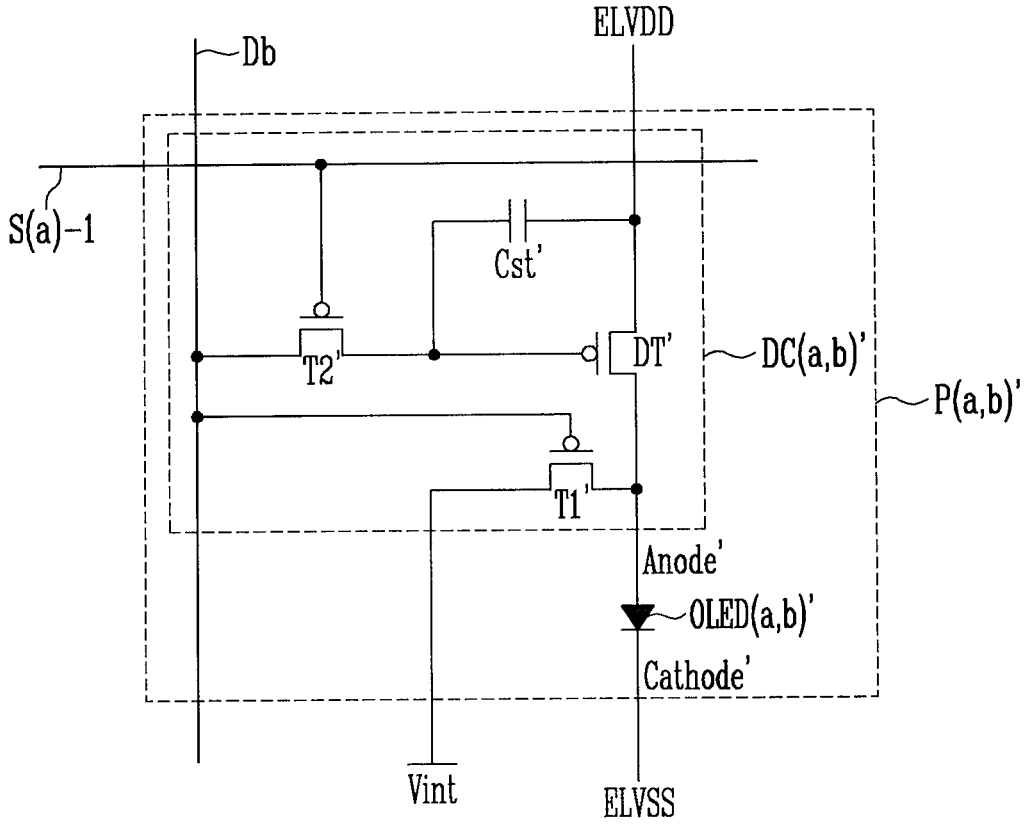
FIG. 3 is a view for describing another example of a structure of pixels included in the display panel of FIG. 1.

FIG. 3 is a view for describing another example of a structure of pixels included in the display panel of FIG. 1.

The pixel P(a, b)' of the present embodiment includes an organic light emitting diode OLED(a, b)' and a driving circuit DC(a, b)' for supplying a current to the organic light emitting diode OLED(a, b)', and the driving circuit DC(a, b)' includes a driving transistor DT', first and second transistors T1' and T2', and a storage capacitor Cst'. The organic light emitting diode OLED(a, b)' includes an anode Anode' and a cathode Cathode'. The pixel P(a, b)' is electrically connected to the data line Db, the scan line S(a)-1, and may be connected to the emission control line E(a)-1. The driving transistor DT', the first transistor T1', and the second transistor T2' may each be a pMOS transistor, although this is merely an example. Alternatively, the driving transistor DT' and the first and second transistors T1' to T2' may be nMOS transistors.

The driving transistor DT' controls the level of a current flowing in the organic light emitting diode OLED(a, b)' based on the level of a voltage supplied to the data line Db that is electrically connected to the pixel P(a, b)'. Specifically, the first power ELVDD is supplied to the first electrode of the driving transistor DT', and the second electrode of the driving transistor DT' is electrically connected to the anode Anode'. In this regard, for convenience of description, the first electrode of the driving transistor DT' may serve as the source electrode, and the second electrode of the driving transistor DT' may serve as the drain electrode. However, this is merely an example. According to types of the transistors, it may be determined whether the first electrode serves as the source electrode or the drain electrode, and whether the second electrode serves as the drain electrode or the source electrode. A method by which the driving transistor DT' controls the level of a current flowing in the organic light emitting diode OLED(a, b)' will be described in detail later.

A first electrode of the first transistor T1' is electrically connected to the anode Anode' of the organic light emitting diode OLED(a, b)', the initialization power Vint is supplied to a second electrode of the first transistor T1', and a gate electrode of the first transistor T1 is electrically connected to the data line Db. When the level of a data voltage supplied to the data line Db is equal to or lower than a given voltage level (e.g., 0 V), the first transistor T1' is turned on to supply the initialization power Vint to the anode Anode' of the organic light emitting diode OLED(a, b)', and the organic light emitting diode OLED(a, b)' does not emit light as a result.

A first electrode of the second transistor T2' is electrically connected to the data line Db, a second electrode of the second transistor T2' is electrically connected to the first electrode of the driving transistor DT', and a gate electrode of the second transistor T2' is electrically connected to the scan line S(a)-1. When a scan signal is supplied to the scan line S(a)-1, the second transistor T2' is turned on to supply a data voltage from the data line Db to the first electrode of the driving transistor DT'.

The first power ELVDD is supplied to a first end of the storage capacitor Cst', and a second end of the storage capacitor Cst' is electrically connected to a gate electrode of the driving transistor DT'. The storage capacitor Cst' maintains a difference between the first power ELVDD and the gate electrode of the driving transistor DT'.

A driving method of the pixel P(a, b)' will be described in detail. Because it is assumed that the pixel P(a, b)' is driven, it may be assumed that the level of a voltage supplied through the data line Db is equal to or greater than a given voltage level (e.g., 2 V). As a result, the first transistor T1' maintains a turn-off state.

While a scan signal is supplied to the scan line S(a)-1, the second transistor T2' is turned on to supply the data voltage from the data line Db to the gate electrode of the driving transistor DT'. Although the supply of the scan signal to the scan line S(a)-1 is stopped, the storage capacitor Cst' maintains a voltage between the first electrode and the gate electrode of the driving transistor DT' until a next frame. A current which flows from the first power ELVDD through the driving transistor DT' flows in the organic light emitting diode OLED(a, b)'. Accordingly, the level of a current flowing in the organic light emitting diode OLED(a, b)' may be controlled by the driving transistor DT', and may be calculated by using Equation 3.

$$Ids=k\{(ELVDD-V\text{data})-Vth\}^2=k\{ELVDD-V\text{data}-Vth\}^2 \quad \text{Equation 3}$$

Ids: the level of the current flowing between the first electrode and the second electrode of the driving transistor DT', k: a proportional factor, ELVDD: a voltage level of the first power ELVDD, Vdata: a level of the data voltage supplied to the data line Db, and Vth: a threshold voltage of the driving transistor DT'.

Because luminance of light emitted from the organic light emitting diode OLED(a, b)' is proportional to the level of a supplied current, the pixel P(a, b)' illustrated in FIG. 3 has a simple circuit structure, but is affected by the threshold voltage Vth of the driving transistor DT'. Also, in the embodiment of FIG. 3, although no signal is supplied to the scan line S(a)-1 and the emission control line E(a)-1, when the data voltage from the data line Db is lower than a predetermined level, the pixel P(a, b)' included in the organic light emitting display device emits no light. As a result, the first signal driver 240-1 may be not driven, thereby reducing power consumption.

Figure 4:
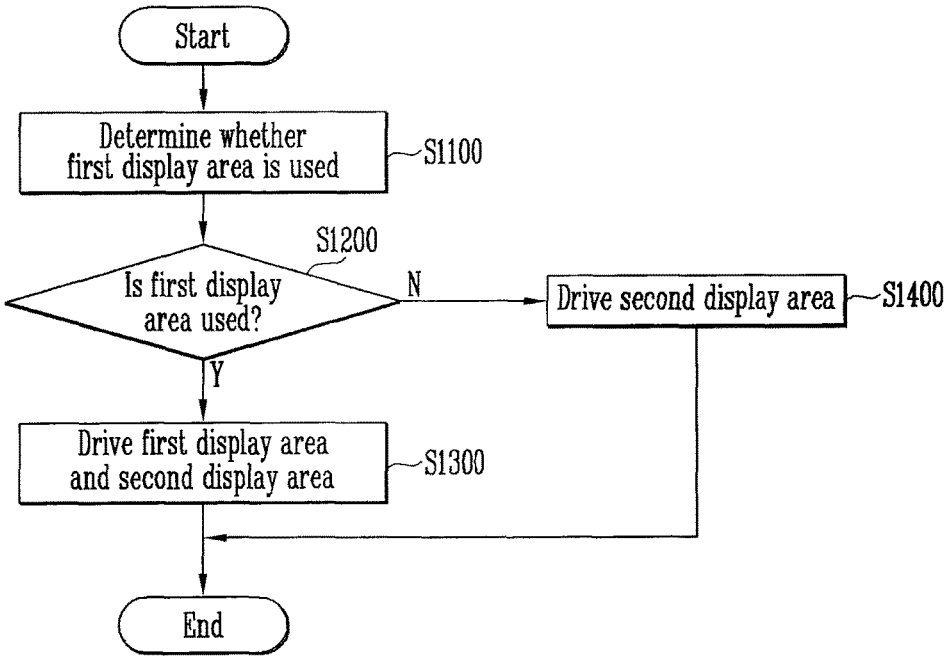
FIG. 4 is a flowchart for describing a driving method of an organic light emitting display device according to an exemplary embodiment of the present invention.

FIG. 4 is a flowchart for describing a driving method of an organic light emitting display device according to an exemplary embodiment of the present invention. Hereinafter, a driving method of the organic light emitting display device will be described with reference to FIG. 1 to FIG. 4.

At S1100, it is determined whether a first display area 100-1 of the display panel 100 is used. Details of S1100 will be described later with reference to FIG. 5.

At S1200, when it is determined that the first display area 100-1 is used, S1300 is executed. When it is determined that the first display area 100-1 is not used, S1400 is executed.

At S1300, the first display area 100-1 and the second display area 100-2 are driven. The timing controller 220 determines that the first display area 100-1 is used, and the data driver 230 receives a use-determining signal "Use" having the first logic value. Details of S1300 will be described later with reference to FIG. 6.

At S1400, the first display area 100-1 is not driven, and the second display area 100-2 is driven. The timing controller 220 determines that the first display area 100-1 is not used, and data driver 230 receives a use-determining signal "Use" having the second logic value. Details of S1400 will be described later with reference to FIG. 7.

Figure 5:
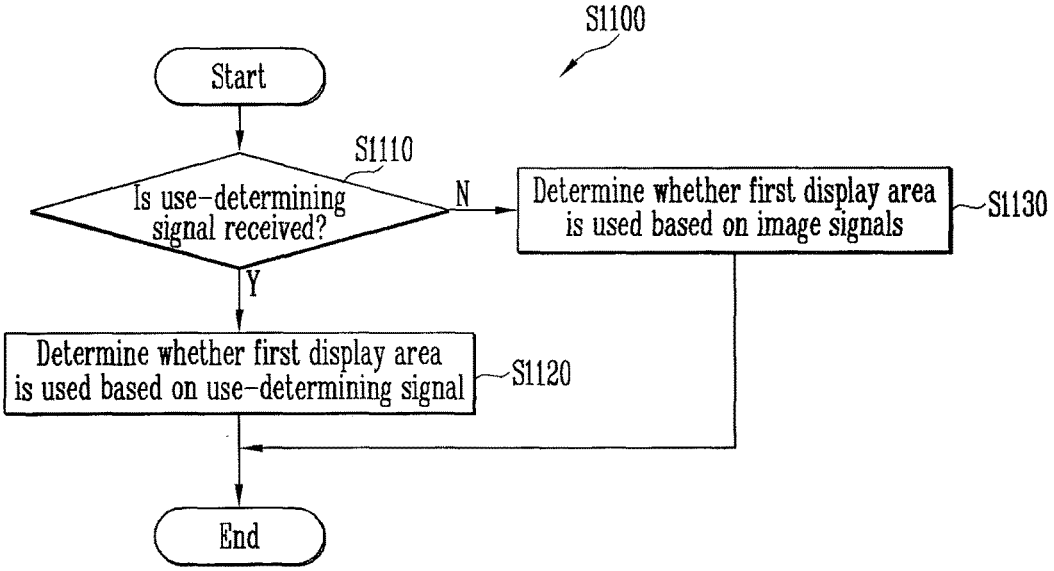
FIG. 5 is a flowchart for describing a method of determining whether a first display area is used in the driving method of the organic light emitting display device of FIG. 4.

FIG. 5 is a flowchart for describing a method of determining whether a first display area is used in the driving method of the organic light emitting display device of FIG. 4. Hereinafter, S1100 will be described with reference to FIG. 1, FIG. 2, FIG. 4, and FIG. 5.

At S1110, it is determined whether the timing controller 220 receives the externally supplied use-determining signal "Use." In the case of receiving the use-determining signal, S1120 is executed. In the case of not receiving the use-determining signal, S1130 is executed.

At S1120, it is determined based on the use-determining signal "Use" that the first display area 100-1 is used. When the use-determining signal "Use" received by the timing controller 220 has the first logic value, the timing controller 220 determines that the first display area 100-1 is used. When the use-determining signal "Use" received by the timing controller 220 has the second logic value, which is different from the first logic value, then the timing controller 220 determines that the first display area 1000-1 is not used.

At S1130, it is determined based on image signals RGB that the first display area 100-1 is used. When at least a portion of the image signals corresponding to a first display area among the image signals RGB do not correspond to black grays, then the display panel driver 200 determines that the first display area 100-1 is used. In contrast, when all of the image signals corresponding to a first display area among the image signals RGB correspond to the black grays, the display panel driver 200 determines that the first display area 100-1 is not used.

Figure 6:
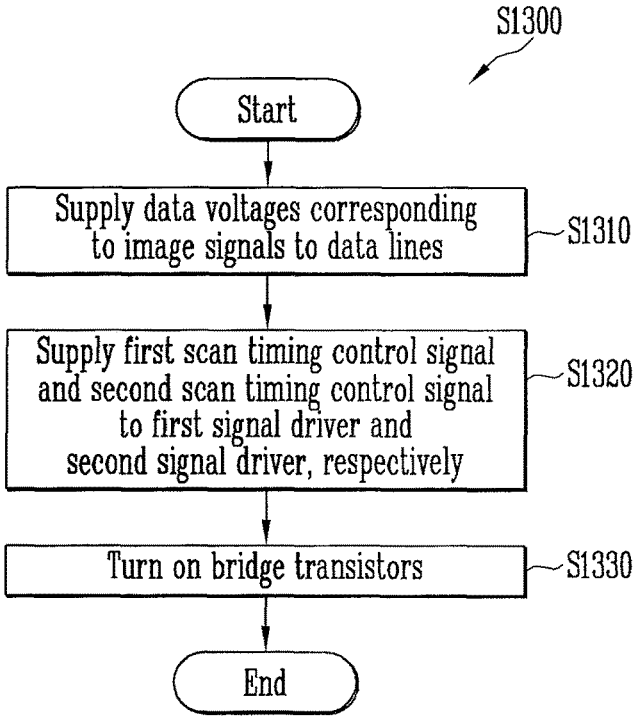
FIG. 6 is a flowchart for describing a method of driving a first display area and a second display area in the driving method of organic light emitting display device of FIG. 4.

FIG. 6 is a flowchart for describing a method of driving a first display area and a second display area in the driving method of organic light emitting display device of FIG. 4. Hereinafter, S1300 will be described with reference to FIG. 1 to FIG. 6.

At S1310, the data driver 230, which receives the use-determining signal "Use" having the first logic value, supplies data voltages corresponding to the received image signals RGB. The data voltages are supplied to the pixels P through the data lines D.

At S1320, the timing controller 220 respectively supplies the first scan timing control signal SCSI and the second scan timing control signal SCS2 to the first signal driver 240-1 and the second signal driver 240-2, respectively. When the display panel 100 includes the emission control lines E, the first emission timing control signal ECS1 and the second emission timing control signal ECS2 are additionally respectively supplied to the first signal driver 240-1 and the second signal driver 240-2.

At S1330, the bridge transistors BT are turned on. The data driver 230, which receives the use-determining signal "Use" having the first logic value, turns on the bridge transistors BT by supplying a voltage of a level that is lower than a given voltage level to the bridge transistor control line BTC in response to the use-determining signal "Use".

Figure 7:
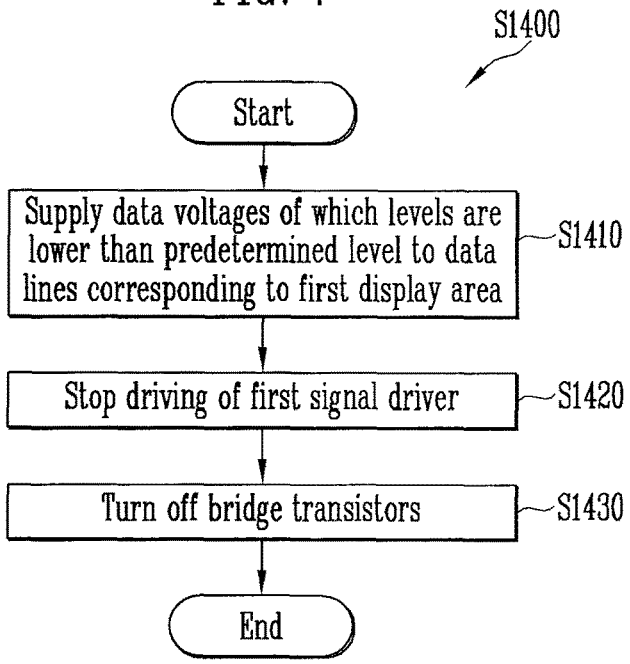
FIG. 7 is a flowchart for describing a method of driving a first display area and a second display area in the driving method of organic light emitting display device of FIG. 4.

FIG. 7 is a flowchart for describing a method of driving a first display area and a second display area in the driving method of organic light emitting display device of FIG. 4.

At S1410, the data driver 230, which receives the use-determining signal "Use" having the second logic value, supplies a data voltage of a voltage level that is lower than a given voltage level to the data lines D-1 corresponding to the first display area 100-1. The level of the data voltage supplied to the data lines D-1 is unrelated to the received image signals RGB. The data voltages corresponding to the image signals RGB are supplied to the data lines D-2 corresponding to the second display area 100-2.

At S1420, the timing controller 220 stops the driving of the first signal driver 240-1 and drives the second signal driver 240-2. The timing controller supplies the second scan timing control signal SCS2 to the second signal driver 240-2. When the display panel 100 includes the emission control lines E, the second emission timing control signal ECS2 is supplied to the second signal driver 240-2.

At 1430, the bridge transistors BT are turned off. The data driver 230, which receives the use-determining signal "Use" having the second logic value, turns off the bridge transistors BT by supplying a voltage level that is higher than the given voltage level to the bridge transistor control line BTC in response to the use-determining signal "Use." By the action of S1430, the scan lines S-2 for driving the second display area 100-2 and the emission control signals and the scan signals supplied to the emission control lines E-2 and the scan lines S-2 do not flow in the first display area 100-1. As a result, when the second display area 100-2 is exclusively driven, the scan lines S-2 for driving the second display area 100-2 and the emission control lines E-2 do not cause the first pixels P-1 to malfunction.

By the action of S1400, the first signal driver 240-1 might not be driven, thereby reducing a power consumption. Although the scan signals and emission control signals are not supplied to the first pixels P-1, the data voltage level that is lower than the given voltage level is supplied to the first data lines D-1, and thus the first pixels P-1 do not emit light.

Example embodiments have been disclosed herein and although specific terms are employed, they are used and are to be interpreted in a generic and descriptive sense only and not for purpose of limitation. In some instances, as would be apparent to one of ordinary skill in the art as of the filing of the present application, features, characteristics and/or elements described in connection with a particular embodiment may be used singly or in combination with features, characteristics and/or elements described in connection with other embodiments unless otherwise specifically indicated. Accordingly, it will be understood by those of skill in the art that various changes in form and details may be made without departing from the spirit and scope of the present invention as set forth in the following claims and their equivalents.

What is claimed is:

1. A pixel comprising:

an organic light emitting diode; and a driving circuit configured to supply current to the organic light emitting diode, the driving circuit comprising:

a driving transistor configured to control a level of the current flowing in the organic light emitting diode based on a level of a voltage supplied to a data line;

a first transistor comprising a first electrode electrically connected to an anode of the organic light emitting diode, a second electrode configured to receive an initialization power, and a gate electrode electrically connected to the data line; and a seventh transistor comprising a first electrode electrically connected to the anode of the organic light emitting diode, a second electrode configured to receive the initialization power, and a gate electrode electrically connected to a third scan line, wherein the first transistor is configured to supply the initialization power to the anode of the organic light emitting diode when the first transistor is turned on such that the organic light emitting diode does not emit light.

2. The pixel of claim 1, wherein the driving circuit further comprises:

a second transistor comprising a first electrode electrically connected to the data line, a second electrode electrically connected to a first electrode of the driving transistor, and a gate electrode electrically connected to a first scan line;

a third transistor comprising a first electrode electrically connected to a second electrode of the driving transistor, a second electrode electrically connected to a gate electrode of the driving transistor, and a gate electrode electrically connected to the first scan line;

a fourth transistor comprising a first electrode electrically connected to the gate electrode of the driving transistor, a second electrode configured to receive the initialization power, and a gate electrode electrically connected to a second scan line;

a fifth transistor comprising a first electrode configured to receive a first power, a second electrode electrically connected to the first electrode of the driving transistor, and a gate electrode electrically connected to an emission control line;

a sixth transistor comprising a first electrode electrically connected to the second electrode of the driving transistor, a second electrode electrically connected to the anode of the organic light emitting diode, and a gate electrode electrically connected to the emission control line;

a storage capacitor comprising a first end configured to receive the first power, and a second end electrically connected to the gate electrode of the driving transistor.

3. The pixel of claim 2, wherein a cathode of the organic light emitting diode is configured to receive a second power having a second voltage level that is lower than a first voltage level of the first power, and wherein the first scan line is configured to receive a scan signal after the scan signal is supplied to the second scan line and to the third scan line.

4. The pixel of claim 1, wherein the driving transistor comprises a first electrode that is configured to receive a first power, and a second electrode that is electrically connected to the anode of the organic light emitting diode, wherein the driving circuit further comprises:

a second transistor comprising a first electrode electrically connected to the data line, a second electrode electrically connected to a gate electrode of the driving transistor, and a gate electrode electrically connected to a scan line; and a storage capacitor comprising a first end configured to receive the first power, and a second end electrically connected to the gate electrode of the driving transistor, and wherein a cathode of the organic light emitting diode is configured to receive a second power having a second voltage level that is lower than a first voltage level of the first power.

5. An organic light emitting display device comprising:

a display panel comprising a first display area and a second display area that do not overlap each other; and a display panel driver configured to drive the display panel, wherein the display panel further comprises:

scan lines configured to transfer scan signals;

data lines configured to transfer data voltages;

pixels in the first display area or the second display area and electrically connected to the scan lines and the data lines; and bridge transistors between the first display area and the second display area, wherein the display panel driver comprises:

a data driver configured to generate the data voltages based on received image signals;

a first signal driver configured to generate scan signals that are supplied to the first display area; and a second signal driver configured to generate scan signals that are supplied to the second display area, wherein the scan signals supplied to the second display area are not supplied to the first display area, and the scan signals supplied to the first display area are not supplied to the second display area, when the bridge transistors are turned off, and wherein, when a predetermined condition is satisfied, the first signal driver is not driven and the pixels in the first display area do not emit light.

6. The organic light emitting display device of claim 5, wherein the first display area is flat, and the second display area is curved.

7. The organic light emitting display device of claim 5, wherein each of the pixels in the first display area comprises an organic light emitting diode, and a driving circuit configured to supply a current to the organic light emitting diode, wherein the driving circuit comprises:

a driving transistor configured to control a level of current flowing in the organic light emitting diode based on a level of a voltage supplied to one of the data lines; and a first transistor comprising a first electrode electrically connected to an anode of the organic light emitting diode, a second electrode configured to receive an initialization power, and a gate electrode electrically connected to the one of the data lines, and wherein the first transistor is configured to be turned on to supply the initialization power to the organic light emitting diode when the predetermined condition is satisfied.

8. The organic light emitting display device of claim 7, further comprising emission control lines configured to transfer emission control signals to the pixels, wherein the first signal driver is further configured to generate the emission control signals supplied to the first display area, wherein the second signal driver is further configured to generate the emission control signals supplied to the second display area, wherein the driving circuit further comprises:

a second transistor comprising a first electrode electrically connected to the one of the data lines, a second electrode electrically connected to a first electrode of the driving transistor, and a gate electrode electrically connected to a first scan line;

a third transistor comprising a first electrode electrically connected to a second electrode of the driving transistor, a second electrode electrically connected to a gate electrode of the driving transistor, and a gate electrode electrically connected to the first scan line;

a fourth transistor comprising a first electrode electrically connected to the gate electrode of the driving transistor, a second electrode configured to receive the initialization power, and a gate electrode electrically connected to a second scan line;

a fifth transistor comprising a first electrode configured to receive a first power, a second electrode electrically connected to the first electrode of the driving transistor, and a gate electrode electrically connected to an emission control line;

a sixth transistor comprising a first electrode electrically connected to the second electrode of the driving transistor, a second electrode electrically connected to the anode of the organic light emitting diode, and a gate electrode electrically connected to the emission control line;

a seventh transistor comprising a first electrode electrically connected to the anode of the organic light emitting diode, a second electrode configured to receive the initialization power, and a gate electrode electrically connected to a third scan line; and a storage capacitor comprising a first end configured to receive the first power, and a second end electrically connected to the gate electrode of the driving transistor, and wherein a cathode of the organic light emitting diode is configured to receive a voltage level of a second power that is lower than a voltage level of the first power.

9. The organic light emitting display device of claim 7, wherein each of the pixels have a same structure.

10. The organic light emitting display device of claim 5, wherein the display panel driver further comprises a timing controller that is configured to:

generate a data timing control signal and a scan timing control signal based on externally supplied image signals or timing signals;

output the image signals and the data timing control signal to the data driver;

drive the first signal driver and the second signal driver, and output the scan timing control signal to the first signal driver and the second signal driver, when a use-determining signal having a first logic value is received; and drive the second signal driver, and output the scan timing control signal to the second signal driver, when the use-determining signal having a second logic value that is different from the first logic value is received.

11. The organic light emitting display device of claim 10, wherein the timing controller is further configured to:

generate an emission timing control signal;

output the emission timing control signal to the first signal driver and to the second signal driver when the use-determining signal having the first logic value is received; and output a scan timing control signal and the emission timing control signal to the second signal driver when the use-determining signal having the second logic value is received.

12. A driving method of an organic light emitting display device comprising a display panel having a first display area and a second display area that do not overlap each other, and a display panel driver configured to drive the display panel, the method comprising:

determining whether the first display area is used;

driving the first display area and the second display area when it is determined that the first display area is used; and driving the second display area when it is determined that the first display area is not used, wherein the display panel further comprises:

bridge transistors between the first display area and the second display area, scan lines configured to transfer scan signals;

data lines configured to transfer data voltages; and pixels in the first display area or the second display area and electrically connected to the scan lines and the data lines, wherein the display panel driver comprises:

a data driver configured to generate the data voltages based on received image signals;

a first signal driver configured to generate scan signals supplied to the first display area; and a second signal driver configured to generate scan signals supplied to the second display area, and wherein the driving of the second display area comprises:

supplying data voltages having voltage levels that are lower than a given voltage level to data lines corresponding to the first display area;

stopping the driving of the first signal driver; and turning off the bridge transistors.

13. The driving method of claim 12, wherein the determining whether the first display area is used comprises:

receiving and analyzing a use-determining signal when the use-determining signal is received from the outside; and determining that the first display area is used when the use-determining signal has a first logic value; and determining that the first display area is not used when the use-determining signal has a second logic value that is different from the first logic value; or receiving and analyzing image signals when the use-determining signal is not received from the outside; and determining that the first display area is used when at least one of the image signals corresponding to the first display area does not correspond to black grays; and determining that the first display area is not used when all of the image signals corresponding to the first display area corresponds to black grays.

14. The driving method of claim 12, wherein each of the pixels comprises an organic light emitting diode, and a driving circuit configured to supply current to the organic light emitting diode, the driving circuit comprising:

a driving transistor configured to control a level of current flowing in the organic light emitting diode based on a voltage level supplied to one of the data lines; and a first transistor comprising a first electrode electrically connected to an anode of the organic light emitting diode, a second electrode configured to receive an initialization power, and a gate electrode electrically connected to the one of the data lines, and wherein, the supplying data voltages having voltage levels that are lower than a given voltage level to data lines corresponding to the first display area comprises:

turning on the first transistor; and supplying the initialization power to the anode of the organic light emitting diode to prevent light emission from the organic light emitting diode.

15. The driving method of claim 12, wherein the driving of the first display area and the second display area comprises:

generating data voltages corresponding to the received image signals to the data lines;

supplying a first scan timing control signal and a second scan timing control signal to the first signal driver and the second signal driver, respectively; and turning on the bridge transistors.

* * * * *